US009351590B1

(12) United States Patent
Wildrick et al.

(10) Patent No.: US 9,351,590 B1
(45) Date of Patent: May 31, 2016

(54) ADJUSTABLE DEPTH WIRE DIVIDER FOR GONDOLA SHELVING

(71) Applicants: Richard J. Wildrick, Hunlock Creek, PA (US); Joseph F. Kologe, Scranton, PA (US); William Healey, Wilkes-Barre, PA (US)

(72) Inventors: Richard J. Wildrick, Hunlock Creek, PA (US); Joseph F. Kologe, Scranton, PA (US); William Healey, Wilkes-Barre, PA (US)

(73) Assignee: TRION INDUSTRIES, INC., Wilkes-Barre, PA (US)

( * ) Notice: Subject to any disclaimer, the term of this patent is extended or adjusted under 35 U.S.C. 154(b) by 0 days.

(21) Appl. No.: 14/815,533

(22) Filed: Jul. 31, 2015

(51) Int. Cl.
*A47F 5/14* (2006.01)
*A47F 5/00* (2006.01)
*A47B 96/04* (2006.01)

(52) U.S. Cl.
CPC ..... *A47F 5/0056* (2013.01); *A47B 96/04* (2013.01)

(58) Field of Classification Search
CPC ..... A47F 5/0056; A47F 5/005; A47B 96/04; A47B 96/07; A47B 57/58; A47B 88/20; A47B 57/583; A47B 57/588; A47B 57/585
USPC ..... 211/184, 43
See application file for complete search history.

(56) References Cited

U.S. PATENT DOCUMENTS 2,910,188 A * 10/1959 Skolfield ..... A47B 57/581 126/9 B
3,497,081 A * 2/1970 Field ..... A47B 57/58 211/184
3,501,020 A * 3/1970 Krikorian ..... A47F 5/005 211/184
3,608,741 A * 9/1971 Schray ..... A47B 5/005 211/184
3,692,191 A * 9/1972 Moore ..... A47B 57/585 211/184
6,685,037 B1 2/2004 Zadak
D664,794 S 8/2012 Leveto
2004/0011754 A1* 1/2004 Zadak ..... A47B 57/58 211/184
2006/0096938 A1* 5/2006 Kanou ..... A47B 3/0486 211/184
2008/0258593 A1* 10/2008 Berger ..... A47B 88/20 312/348.3
2013/0020270 A1* 1/2013 Valiulis ..... A47B 5/005 211/59.2

* cited by examiner

*Primary Examiner* — Brian Mattei
(74) *Attorney, Agent, or Firm* — St. Onge Steward Johnston & Reens LLC

(57) ABSTRACT

A telescopically adjustable shelf divider for dividing merchandise shelving having different front-to-back depth dimensions and non-standardized openings in the surfaces thereof. Front and back divider panels are formed by vertically spaced apart and horizontally extending panel-forming elements arranged so that the panel-forming elements of one divider panel lie in a common plane with the panel-forming elements of the other divider panel and at least one panel-forming element of one panel is slidably supported by a panel-forming element of the other divider panel. Retaining elements are fixed to panel-forming elements of one divider panel and extend vertically beyond a panel-forming element of the other divider panel to maintain the panels is overlapping, telescopically adjustable relation. Panel-mounting elements extend downward from the respective divider panels for reception in openings in the shelving surface, and a stabilizing element extends transversely from one panel to retain the divider in a vertical orientation.

21 Claims, 5 Drawing Sheets

ADJUSTABLE DEPTH WIRE DIVIDER FOR GONDOLA SHELVING

FIELD OF THE INVENTION

This invention relates to shelf dividers for use in connection with gondola shelving and the like commonly used in retail stores and supermarkets for the display of merchandise. Shelf dividers, mounted on a shelf and extending in a front-to-back direction are employed to separate a shelf into a plurality of sections, laterally, in order to display different items of merchandise and to maintain them separated from each other.

BACKGROUND OF THE INVENTION

Retails stores of all types make use of gondola shelving, which typically involves a plurality of gondola units comprised of a base, a vertical backboard, and a plurality of horizontal shelves extending outward from the backboard. The gondolas typically are manufactured in standardized widths and heights, such as 48 inches wide by 60 inches high. The gondola shelves typically are provided in a variety of depth dimensions (front to back), in order to accommodate different store layouts and different types of products to be displayed. Typically, the different depths of such shelving vary in standardized increments of two inches.

In order to separate a gondola shelf into different product sections it is a common practice to install one or more dividers, extending from front to back, frequently in conjunction with a fence extending along the front of the shelf. It is desirable that the shelf dividers be capable of easy installation and removal in order to accommodate changes in the product mix on display, which often dictates changes in the sectioning of the shelf.

A problem faced by the store keeper in connection with the above is that shelves of different depth require shelf dividers of corresponding depth. This in turn requires the store keeper to maintain on hand a significant inventory of dividers of various depth dimensions. As can be readily appreciated, this results in significant cost and logistical issues in connection with the organizing and storage of dividers of a variety of different sizes.

Attempts have been made heretofore to provide shelf dividers of adjustable depth, in an effort to avoid the necessity of carrying a large inventory of dividers to accommodate the different shelf depths. Such earlier attempts have not, however, been entirely successful either because of excessive cost or limited functionality, or both. One example is reflected in U.S. Design Pat. No. D664,794, which discloses a divider comprised of telescopically engaged front and back parts, which can, within its limits, be adjusted to fit a shelf of any width. A common form of gondola shelving is constructed of sheet metal and is provided with rows of openings adjacent to the front and back edges of the shelf. The divider of the '794 patent includes elements at the front and back that project downward and can be received in such openings in order to position the divider on the shelf. A hook is provided at the front of the divider for engaging a front fence, to both maintain the divider in a vertical orientation and to assist in the support of the front fence. While the divider of the '794 patent can be functionally effective, it is very costly to manufacture and thus not well suited for widespread adoption in many stores and supermarket chains.

Another attempt to provide a shelf divider with adjustability in its depth is reflected in the Zadak U.S. Pat. No. 6,685,037. This patent discloses a shelf divider formed of front and back sections that are adjustable in increments of one inch within its limits. Each section of the divider is constructed with vertically disposed wires, spaced at one inch intervals, and a clip is mounted on each section to engage and grip a vertical wire of the other section. To adjust the depth of the divider, the two sections are pushed toward each other, in a shortening direction, to disengage the clips from the vertical wires with which they are currently engaged. The two divider parts are then separated and repositioned in a configuration of slightly less depth than desired, and the two parts are then pulled in a lengthening direction to cause the clips to engage a new set of vertical wires with a snap-together action. The assembled divider is designed to be flexed in a vertical plane to enable hooks along the bottom edge thereof to be engaged with openings in the surface of the shelf for securing the divider in position. The divider of the '037 patent has certain shortcomings in the fact that adjustment is incremental and requires disengagement of the clips, separation and repositioning of the two divider parts, and re-engagement of clips. Moreover, although the gondola shelving is widely available in standardized depths, there is less than full standardization in the spacing and positioning of openings in gondola shelving. Accordingly, while an incrementally adjustable shelf divider may be able to accommodate all of the standardized shelf depths within its range of adjustment, a standardized incremental depth adjustment may not enable such a divider to engage with shelf openings which differ from the expected standard of hole spacing.

Thus, there remains a need for an improved shelf divider which is capable of continuous telescopic adjustability within its range, so as to accommodate shelving of various depths and also non-standardized hole spacing where encountered, yet which is inexpensive to manufacture and can be provided to stores and supermarkets on an economically viable cost basis. The present invention satisfies that need.

SUMMARY OF THE INVENTION

The present invention is directed to a novel and improved form of depth-adjustable shelf divider which is continuously telescopically adjustable within its limits, so as to be usable with shelving of any depth within its range, including shelving with non-standardized hole spacing, and which at the same time is capable of sufficiently low cost manufacture to make it economically attractive to both small stores and large supermarket chains.

In accordance with one aspect of the invention, a two-part telescopically adjustable depth shelf divider is provided which is comprised of front and back divider panels joined in a manner to accommodate continuous telescopic adjustment to fit any shelf within its maximum and minimum limits. Each of the panels is formed by a plurality of horizontally disposed and vertically spaced apart panel-forming elements, advantageously wires, supported at their ends by vertical supports. The vertical supports typically will be formed of wires or rods, preferably of somewhat heavier gauge than the horizontally disposed panel-forming elements. Pursuant to an aspect of the invention, the vertical spacing between horizontal panel-forming elements is such that the panel-forming elements of one panel may be received in spaces between panel-forming elements of the other panel. Additionally, at least one panel-forming element of one panel rests upon and is slideably supported by at least one panel-forming element of the other panel to accommodate and facilitate telescopic adjustments of panels as needed to fit a particular depth of shelving.

Pursuant to another aspect of the invention, joining of the front and back divider panels is accomplished by fixing upper and lower retaining elements to selected panel-forming elements on a divider panel. The retaining elements extend vertically into overlapping relation to a panel-forming element of the opposite divider panel. The overlapped panel-forming elements can be flexed slightly in order to allow the front and back divider panels to be assembled, after which the flexed elements can be released to their normal configurations, in which they will be overlapped by the retaining elements, securing the divider panels in assembled relation while allowing telescopic adjustment thereof. Preferably, the retaining elements are of U-shaped configuration, with the two legs of the "U" welded or otherwise secured to a panel-forming element and the rounded part of the "U" extending into the desired overlapping relation with a panel-forming element of the opposite divider panel.

To advantage, the adjustable shelf divider of the invention is constructed to be self-supporting in a vertical orientation, so as to be useable with or without a fence along the front edge of the shelf. In this respect, many existing shelf dividers rely upon a hook at the front of the divider to engage a front fence, serving both to support the fence and to retain the divider in a vertical orientation. The shelf divider of the invention utilizes front and back mounting elements received in respective front and back openings in the sheet metal shelving. The front mounting element advantageously is vertically disposed while the rear mounting element is angled downward and rearward. A short, transversely disposed cross bar is fixed to an upper portion of one of the mounting elements, preferably the rear element and seats upon the upper surface of the shelf to serve as a stabilizing element to maintain the divider in a vertical orientation independently of any connection with a front fence.

In accordance with another aspect of the invention the front divider panel may be provided with a rigid frame of rod or heavy wire, comprised of front and back upright rod elements connected across their tops by a horizontally extending rod integrally joined with the upright elements. The back divider panel, on the other hand, preferably is formed with front and back upright frame rod elements without a rod connected across their upper ends. Instead, the upright frame rod elements of the back divider panel are connected only by a plurality of horizontally disposed panel-forming elements, typically of wire. Preferably, the back divider panel may be provided with a pair of closely spaced panel-forming elements at its upper and lower edges to provide additional strength without increasing the thickness of the panel.

For a more complete understanding of the above and other features and advantages of the invention, reference should be made to the following detailed description of the invention and to the accompanying drawings.

DETAILED DESCRIPTION OF THE INVENTION

Figure 1:
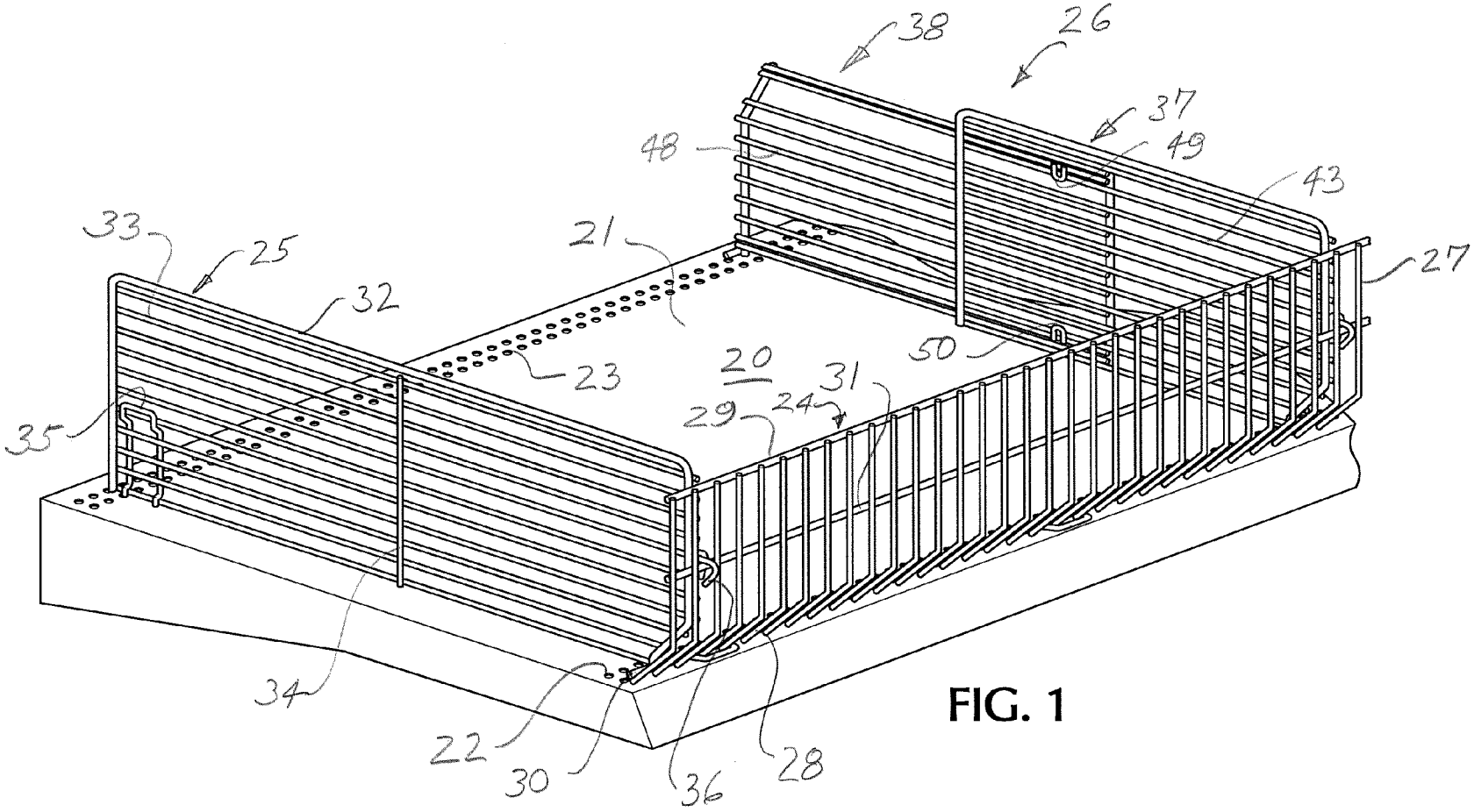
FIG. 1 is a perspective view of a portion of a gondola shelf shown with a front fence and shelf dividers, including a divider according to the invention and a divider according to the prior art.
Figure 2:
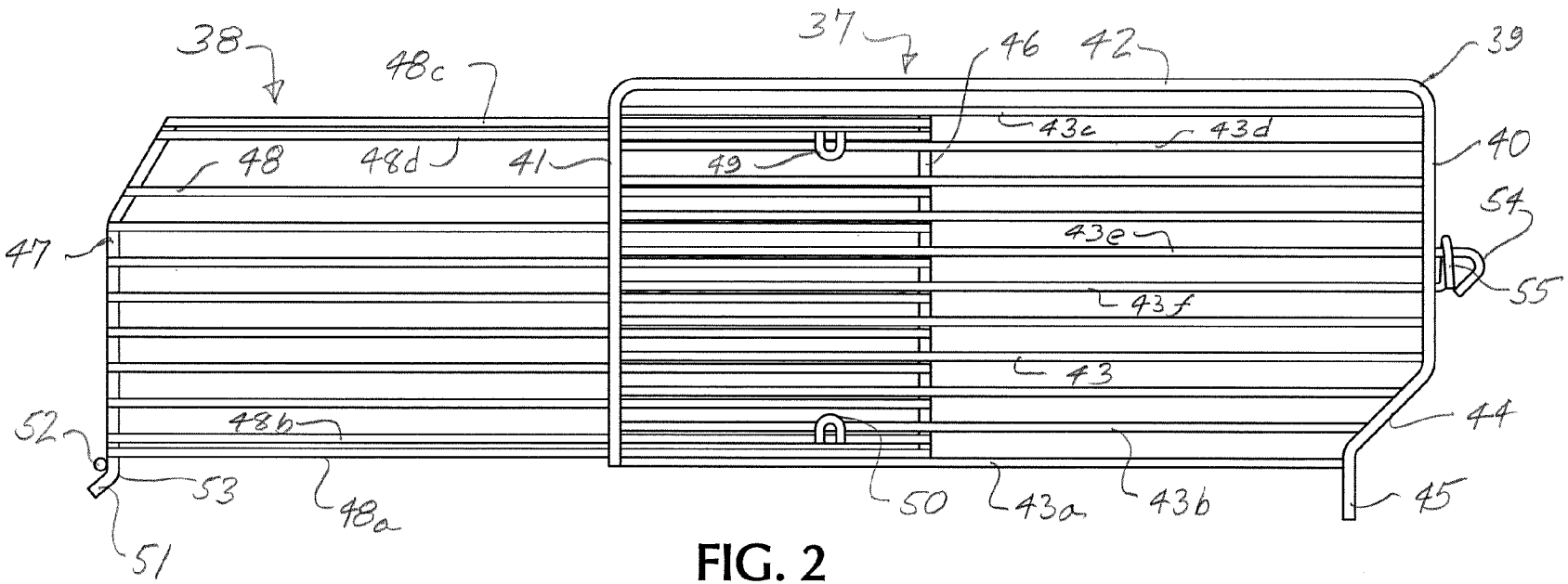
FIG. 2 is a side elevational view of a telescopically adjustable shelf divider according to the invention.
Figure 3:
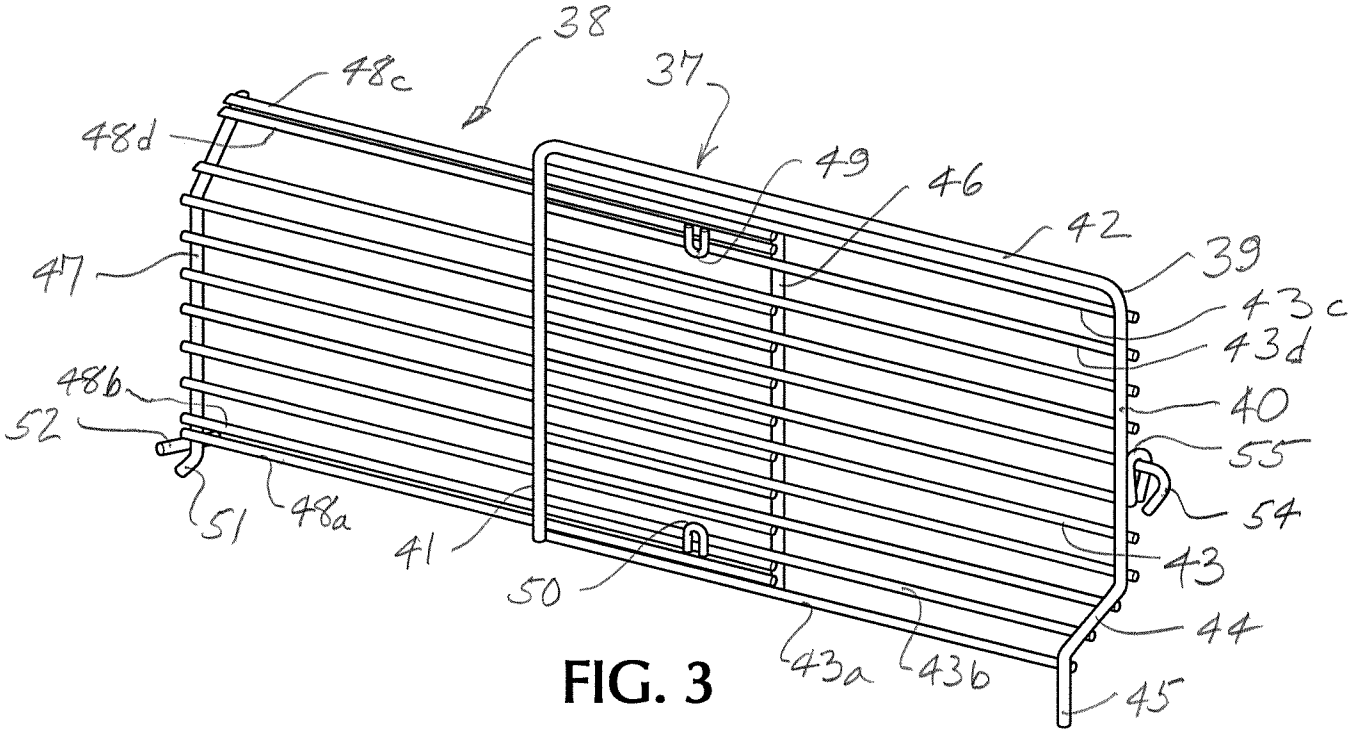
FIG. 3 is a perspective view of the shelf divider of FIG. 2.
Figure 4:
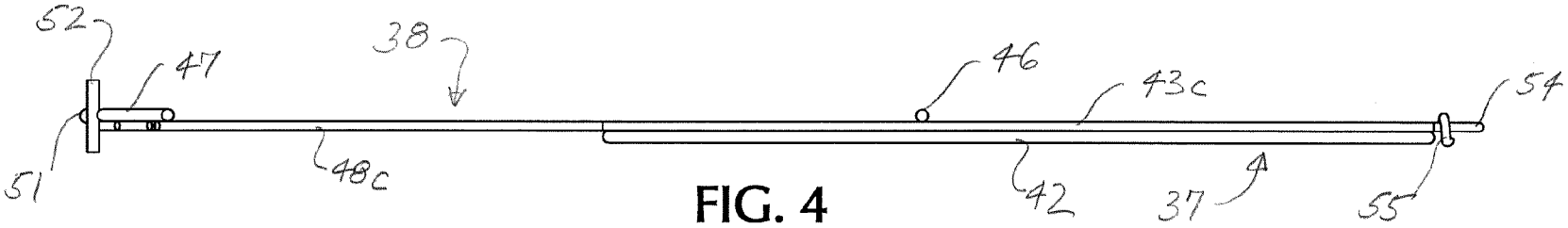
FIGS. 4 and 5 are top plan and front elevational views, respectively, of the shelf divided of FIG. 2.
Figure 5:
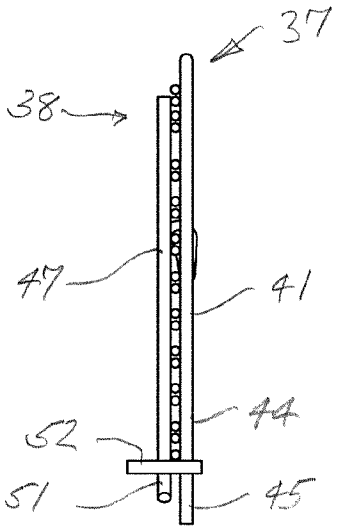
Figure 6:
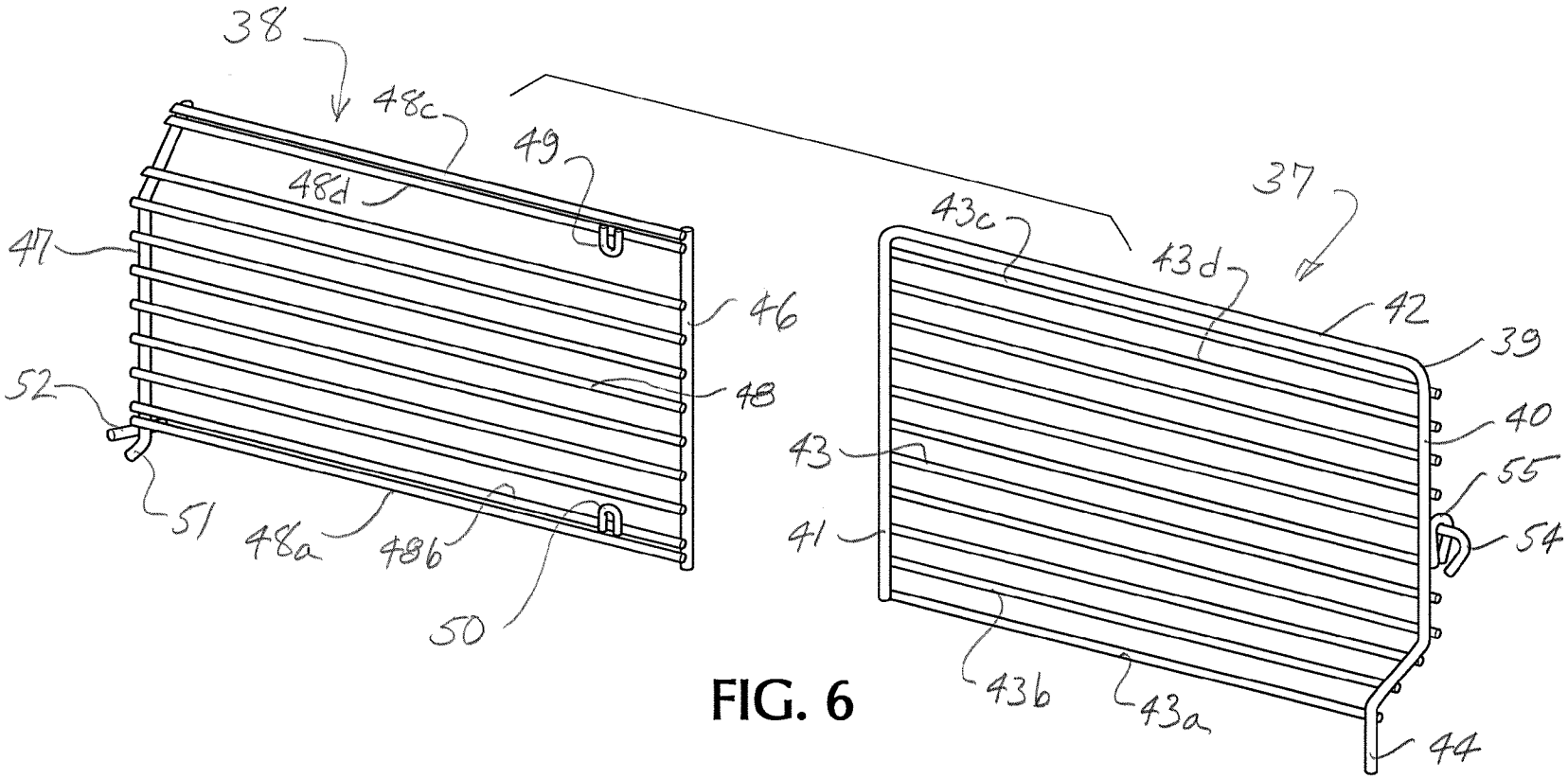
FIG. 6 is an exploded perspective view of the shelf divider of FIG. 2.

Referring to the drawing, an initially to FIG. 1 thereof, the reference numeral 20 designates a typical gondola shelf formed of sheet metal. A standard shelf may be 48 inches wide and of various depths (front to back). Commonly the shelf depths are available in standard increments of two inches. As reflected in FIG. 1, the upper surface 21 of the shelf is provided on its front and back edges with one or more rows of openings 22, 23 intended to receive various shelf attachments including but not limited to front fencing 24 and shelf dividers 25, 26. In the illustration of FIG. 1, the shelf divider 25 is a widely used style of prior art divider, while the divider 26 is constructed in accordance with the invention.

In the illustration of FIG. 1, the front fencing 24, which is well known and forms no part of the present invention, comprises a plurality of upright wires having vertical upper portions 27 and downwardly and rearwardly angled lower portions 28, the lower ends of which are received in front openings 22 of the shelf. The upright wires are connected horizontally by horizontal wires 29, 30 at the top and bottom and 31 at a mid-level.

The prior art divider 25, which is shown for illustrative and background purposes only, comprises a rigid frame 32 of fixed length and of inverted U-shaped configuration, to which are fixed a plurality of vertically spaced, horizontally disposed panel-forming wires 33. A central support 34 is secured to and supports the center regions of the horizontal wires 33. The prior art divider 25 is supplied in a variety of graduated depths or lengths to accommodate the various standard depths of shelving. As will be appreciated, this requires the store keeper to maintain a significant inventory of fixed-depth dividers to provide the desired flexibility in organizing and re-organizing merchandise displays on gondola shelving distributed throughout the store. Moreover, even when a store keeper has a divider of the proper depth for a given shelf depth, there may be a problem in mounting the divider because the hole spacing of a particular shelf of standard depth may not comply with a given standard and spacing. Accordingly, in the illustrated prior art divider 25, the divider is mounted at its front end by a downward extension (not shown) of a front support element and at the back by a slideably movable clip 35 of inverted U-shaped configuration. The clip 35 is held in place by selected ones of the panel-forming wires 33, and can be adjusted forward and backward until the back leg of the clip aligns with an opening at the rear of the shelf, allowing the back leg to be inserted into the opening. A hook 36, at the front end of the divider 25 is engaged with the mid-level wire 31 of the front fence 24, which helps to support the fence and also serves to retain the divider 25 in a vertical orientation.

The novel and improved shelf divider 26 in accordance with the present invention, shown at the right in FIG. 1 is continuously telescopically adjustable to accommodate a variety of shelf depths and also to be adjustable to hole spacings and patterns based on different standards. The shelf divider 26 of the invention, shown in detail in FIGS. 2-6, comprises front and back divider panels 37, 38 joined in overlapping relation for slidable movement. The front panel 37 includes a relatively rigid frame 39, formed of a single length of heavy wire or rod and including front and back frame rods 40, 41 and a top frame rod 42. In a representative embodiment of the invention intended as a shelf divider of 5.5 inch height and adjustable depth of 13-21 inches, the front and back panels each may have a length of about 11.5 inches. This provides for an overlap of about 1.5 inches when the divider is in a maximum extension (21 inches) and of about 10.5 inches when the divider is in a minimum extension.

In the illustrated form of the invention the front panel includes a plurality of panel-forming wires 43, which are horizontally disposed and vertically spaced apart by about one-half inch. The panel-forming wires are fixed at each end to the front and back frame rods 40, 41, typically by welding. In a representative embodiment of the invention, the panel forming wires may have a diameter of about 0.120 inch, while the frame wire may have a diameter of about 0.177 inch. It is intended that the frame wire be relatively rigid while the panel-forming wires can be somewhat flexible. The lowermost wire 43*a* is intended to rest upon the surface 21 of the shelf and support the front panel thereon. Desirably, the front frame rod 40 is angled rearward in a lower portion 44 thereof and has a panel mounting element 45 extending vertically below the lowermost wire 43*a*. The panel mounting element 45 is arranged to be received in one of the front openings 22 (FIG. 1) of the shelf 20 to position the front panel 37 thereon.

The divider back panel 38 is comprised of forward and rearward frame rods 46, 47 which desirably are shorter than front and back frame rods 40, 41 of the front panel 37. The arrangement, as is shown in FIG. 1, is such that the upper end of the forward frame rod 46 of the back panel lies below the top frame rod 42 of the front panel 37. In the illustrated and representative embodiment of the invention, the back panel frame rods 40, 41 can be of about 0.177 inch in diameter, corresponding to the size of the front panel frame rods 40-43. However, in the back panel 38 there is no top rod, corresponding to the top frame rod 42 of the front panel, and the forward and rearward frame rods of the back panel 38 are connected only by a plurality of horizontally disposed and vertically spaced apart panel-forming wires 48, which preferably are of the same diameter (0.120 inch) as the front-panel-forming wires 43.

In accordance with an aspect of the invention, the back-panel-forming wires are fixed to their forward and rearward frame rods on the laterally facing side thereof opposite to that on which the front-panel-forming wires 43 are fixed to their respective front and back frame rods 40, 41, with the opposite sides facing each other to allow the panel-forming wires 43, 48 to contact each other. In addition the vertical spacing of the rear-panel-forming wires 48 is such that they will be received in the spaces between the front-panel-forming wires 43, as clearly shown in FIGS. 1 and 5. Significantly, at least one of the panel-forming wires 43, 48 of one panel 37 or 38 rests upon and is supported by at least one of the panel-forming wires 48, 43 of the other panel. Conveniently, but not necessarily, the lowermost back-panel-forming wire 48*a* rests upon the lowermost front-panel-supporting wire 43*a*. Moreover, the close spacing of others of the panel-forming wires 43, 48 is such that there may be supporting contact between other pairs of vertically adjacent wires at least part of the time and over at least part of the telescopic range of movement of the panels.

To advantage, closely spaced pairs of back-panel-forming wires 48*a*-48*d* may be located at the top and bottom of the back panel 38. This imparts extra strength in these areas, in lieu of forming a more rigid frame by providing a larger diameter top frame rod as for the front panel 37. The absence of a heavier and more rigid top frame rod on the back panel 38 serves to narrow somewhat the effective thickness of the divider over most of its length, which is a factor of considerable importance to the shop keeper. Additionally, the closely spaced pairs of wires 48*a*-48*d* at the top and bottom of the back panel 38 fit closely between upper and lower pairs of front-panel-forming wires 43*a*-43*d*, as can be seen in FIG. 1, this serves to closely confine the wire pairs 48*a*-48*d* between the wire pairs 43*a*-43*d* and thus to help maintain proper alignment of the panels 37, 38 in all telescopically adjusted positions thereof.

To enable the front and back panels 37, 38 to be secured in an assembled and telescopically adjustable relationship, upper and lower retainer elements 49, 50 are fixed (as by welding) to selected back-panel-forming wires and extend vertically to overlap with vertically adjacent front-panel-forming wires 43. In the illustrated embodiment of the invention the retainer elements 49, 50 are formed of wire, of the same gauge as that of the panel-forming wires 43, 48, and are formed in a U-shaped configuration, with the legs of the "U" being fixed to wires 48*b* and 48*d* of the back panel 38 and the closed ends of the "U" extending vertically upward from the wire 48*b* and downward from the wire 48*d* to overlap with vertically adjacent front-panel-forming wires 43. As can be seen in FIG. 1, the rounded ends of the U-shaped retainer elements 49, 50 extend only slightly (approximately one wire diameter) beyond the vertically adjacent wire 43 of the front panel 37. This enables the two panels 37, 38 to be assembled together by initially aligning the retainer elements 49, 50 with middle regions of the overlapped front wires 43 and manually deflecting the front wires enough to snap them over the rounded free ends of the retainer elements 49, 50 and effectively lock the two panels together for telescopic adjustment. Preferably the U-shaped retainer elements 49, 50 are vertically aligned and spaced a predetermined distance, for example about 1.25 inches, from the forward frame rod 46 of the back panel 38. Accordingly, when the assembled divider is expanded to its maximum depth the retainer elements 49, 50 engage the back frame rod 41 of the front panel 37 to stop further telescopic expansion and to maintain a desired minimum overlap of the front and back panels 37, 38.

In a preferred embodiment of the invention, the back of the divider is secured to the display shelf 20 by means of a second panel-mounting element 51, which is formed by a downward and rearward extension of the rear frame rod 47. Preferably the panel-mounting element 51 is disposed at an angle of about 45 degrees to the vertical and is oriented to lie in a common plane with the frame rods 46, 47.

In order to install the divider 26 on the shelf 20, the panels 37, 38 can first be adjusted approximately to the depth of the shelf. The divider is then tilted upward at the front to enable the rearwardly angled panel-mounting element 51 to be inserted in a selected one of the back shelf openings 23. As will be understood, a typical gondola will include a vertical back panel (not shown) positioned in close proximity to or in contact with the back of the shelf 20. Accordingly, to accommodate a degree of upward tilting of the divider 26 during insertion of the panel-mounting element 51, an upper portion 47*a* of the rearward frame rod 47, for example the upper 30%, is angled forward at an angle, for example 30 degrees, to avoid interference with the gondola back panel during installation of the divider. After the panel mounting element 51 has been inserted into the shelf opening, the front of the divider is pivoted downward to enable the front panel-mounting element to be inserted into a selected front shelf opening 22 which typically, but not necessarily, would be aligned front-to-back with the selected back opening 23. If necessary, the divider panels 37, 38 may be telescopically adjusted to align the panel-mounting element 45 with the desired front opening 22 to allow insertion of the element into the opening. The optimum extent and angle of the upper frame rod portion 47*a* typically will be a function of the height of the divider back panel 38, with panels of greater height requiring greater provisions for clearance than panels of lesser height.

Pursuant to a further aspect of the invention, a stabilizing element 52, preferably in the form of a short rod, suitably 1 inch in length, is provided for retaining the divider 26 in a vertical orientation. The stabilizing element 52, which can be the same gauge as the frame rods (0.177 inch), is fixed, typically by welding, to a back-facing surface of the rearward frame rod 47, immediately above a bend 53 therein which defines the upper end of the mounting element 51. The stabilizing element 52 extends symmetrically on opposite sides of a plane defined by the divider panels 37, 38 and, in conjunction with the rearwardly angled back panel-mounting element 51 serves very effectively to retain the shelf divider 26 in a vertical orientation. Accordingly, the divider of the invention can be used to advantage in cases where the store keeper desires to display merchandise without using a front fence 24.

In many cases, a front fence 24 will be desired by the store keeper. Accordingly the front divider panel 37 can be provided with a locking hook arrangement for engagement with the mid-level fence wire 31. One of the front-panel-forming wires 43*e* has a portion extending forward of the front frame rod 40 and bent downwardly to form a hook 54. A second front-panel-forming wire 43*f*, located next below the hook-forming wire 43*e*, also has a portion extending forward of the front frame rod 40 and this portion is formed into a closed or substantially closed loop 55 that extends upward, over the top portion of the hook 54 and back downward to close with the free end of the hook 54. The loop-forming wire is not fixed to the front frame rod 40 but is confined at the front by engagement of the loop 55 with the upper portion of the hook 54. When engaging the hook 54 with a mid-level wire 31 of the front fence, the loop 55 is deflected upwardly to allow entry of the fence wire 31 into the hook. The loop then returns by its normal resilience to the position shown in FIG. 1 to lock the fence wire 31 in engaged relation with the hook 54.

As will be appreciated, the self-supporting nature of the new divider enables it to be used without required support from a front fence structure. Accordingly the new divider optionally may omit the front hook structure altogether for storekeepers who prefer to not use a front fence. Likewise, where the storekeeper expects always to be using a front fence, the front hook structure may be relied upon to maintain the dividers in a desired vertical orientation, and the stabilizing elements 52 optionally may be omitted.

The telescopic shelf divider panel of the invention offers very significant advantages to the store keeper because its continuous adjustability enables it to accommodate not only variations is shelf depth, which generally are varied in standard increments of two inches, but also variations in hole patterns and spacing that can be found on shelving of the same depth. Moreover, the telescopic divider of this invention while providing for continuous adjustment, is so designed and constructed that it may be manufactured at significantly lower cost than known designs of telescopically adjustable dividers and thus can be made available to the store keeper at a sufficiently attractive pricing basis to enable widespread adoption. A feature of particular significance is the arrangement of horizontally disposed, vertically spaced panel-forming wires in a manner such that panel-forming wires of one panel are received in spaces between wires of the other panel, with certain wires of one panel being slideably supported by wires of the other panel disposed directly below. The two panels are held together in assembled relation in a unique manner by small retainer elements fixed to selected panel-forming wires of one panel and extending vertically into slightly overlapping relating with vertically adjacent panel-forming wires of the other panel. The result is an elegantly simple yet functionally highly effective solution to a problem of long standing in the industry.

It should be understood that the specific embodiments of the invention herein shown and described are intended to be representative of the invention and not in limitation thereof. Accordingly reference should be made to the appended claims in determining the full scope of the invention.

What is claimed is:

1. An adjustable depth wire shelf divider which comprises, front and back, vertically oriented overlapping divider panels, said front divider panel comprising front and back upright frame rods and a horizontally disposed top frame rod connected to upper ends of said front and back frame rods and forming a top of said front panel, said front divider panel further including a plurality of vertically spaced and horizontally disposed front-panel-forming wires fixed at front and back ends thereof to laterally facing side surfaces of said front and back frame rods, a first panel-mounting element extending downward below a lowermost one of said front-panel-forming wires for reception in a shelf opening located adjacent a front edge of a shelf to be divided, said back divider panel comprising forward and rearward upright frame rods and a plurality of vertically spaced and horizontally disposed back-panel-forming wires fixed at front and back ends thereof to laterally facing side surfaces of said forward and rearward frame rods, panel-forming wires of the respective front and back divider panels being mounted on opposite side surfaces of the respective upright frame rods facing each other such that, when said front and back panels are assembled in overlapping relation panel-forming wires of one panel can make contact with panel-forming wires of the other panel, a vertical spacing between the horizontal panel-forming wires of the front and back panels being such that, when the panels are overlapped, the panel-forming wires of one panel are received in spaces between panel-forming wires of the other panel and at least one panel-forming wire of one panel lies directly above and is slidably supported by at least one panel-forming wire of the other panel, upper and lower retaining elements mounted on certain of the panel-forming wires of a panel and extending vertically beyond a vertically adjacent panel-forming wire of the other panel for retaining said panels in closely contacting relation with the panel-forming wires of one panel lying substantially in a common plane with panel-forming wires of the other panel, while accommodating horizontal telescopic adjustment of said panels between predetermined limits, a second panel-mounting element extending downward and rearward, at an angle to the vertical, below a lowermost one of said back-panel-forming wires for reception in a shelf opening located adjacent to a back edge of the shelf to be divided, and a stabilizing element fixed to said a back portion of said back panel, extending transversely to said back panel and positioned to rest on a top surface of the shelf to retain said shelf divider in a vertical orientation.

2. The adjustable depth shelf divider of claim 1, wherein said front-panel-forming wires include an upper pair and a lower pair of such wires, each pair being vertically spaced apart predetermined distances, said back-panel-forming wires include an upper pair vertically spaced apart a distance to be able to be closely received between the upper pair of front-panel-forming wires and a lower pair vertically spaced apart a distance to be able to be closely received between the lower pair of front-panel-forming wires.

3. The adjustable depth shelf divider of claim 2, wherein a lower wire of said lower pair of back-panel-forming wires is slidably supported on a lower wire of said lower pair of front-panel-forming wires, and alternatively or in addition, a lower wire of said upper pair of back-panel-forming wires is slidably supported on a lower wire of said upper pair of front-panel-forming wires.

4. The adjustable depth shelf divider of claim 2, wherein said upper retaining element is secured to at least one of said upper pair of back-panel-forming wires and extends downward to a level below a lower wire of said upper pair of front-panel-forming wires, and said lower retaining element is secured to at least one of said lower pair of back-panel-forming wires and extends upward to a level above an upper wire of said lower pair of front-panel-forming wires.

5. The adjustable depth shelf divider of claim 4, wherein said upper retaining element is of U-shaped configuration, and said lower retaining element is of inverted U-shaped configuration.

6. The adjustable depth shelf divider of claim 1, wherein retaining elements mounted on one panel are positioned to engage an upright frame rod of the other panel, forming a stop to limit the maximum extent of telescopic elongation of said divider, and said retaining elements are spaced a predetermined distance from an adjacent upright frame rod of said one panel to provide for a minimum overlap of said front and back panels when said divider is fully extended to said maximum extent.

7. The adjustable depth shelf divider of claim 2, wherein an upper edge of said back panel is formed by a pair of closely spaced panel-forming wires extending between upper ends of the forward and rearward frame rods of said back panel.

8. The adjust able depth shelf divider of claim 7 wherein a lower edge of said back panel is formed by a pair of closely spaced panel-forming wires extending between lower portions of said forward and rearward frame rods of said back panel.

9. An adjustable depth wire shelf divider which comprises, front and back, vertically oriented overlapping divider panels, said front divider panel comprising front and back upright frame rods and a plurality of vertically spaced and horizontally disposed front-panel-forming wires fixed at front and back ends thereof to laterally facing side surfaces of said front and back frame rods, a first panel-mounting element extending downward below a lowermost one of said front-panel-forming wires for reception in a shelf opening located adjacent a front edge of a shelf to be divided, said back divider panel comprising forward and rearward upright frame rods and a plurality of vertically spaced and horizontally disposed back-panel-forming wires fixed at front and back ends thereof to laterally facing side surfaces of said forward and rearward frame rods, panel-forming wires of the respective front and back divider panels being mounted on opposite side surfaces of the respective upright frame rods such that, when said front and back panels are assembled in overlapping relation panel-forming wires of one panel can make contact with panel-forming wires of the other panel, a vertical spacing between the horizontal panel-forming wires of the front and back panels being such that, when the panels are overlapped, the panel-forming wires of one panel are received in spaces between panel-forming wires of the other panel and at least one panel-forming wire of one panel lies directly above and is slideably supported by at least one panel-forming wire of the other panel, at least one retaining element mounted on a panel-forming wire of one of the panels and extending vertically beyond one or more panel-forming wires of the other panel for retaining said panels in closely contacting relation with the panel-forming wires of said one panel lying substantially in a common plane with panel-forming wires of the other panel, while accommodating horizontal telescopic adjustment of said panels between predetermined limits, a second panel-mounting element extending downward from a back of said back panel below a lowermost one of said back-panel-forming wires for reception in a shelf opening located adjacent to a back edge of the shelf to be divided, and a stabilizing element fixed to one of said divider panels and extending transversely thereto and positioned to rest on a top surface of the shelf to retain said shelf divider in a vertical orientation.

10. The adjustable depth shelf divider of claim 9, wherein said upright frame rods are formed of wires of greater diameter than said panel-forming wires, and one of said panel-mounting elements comprises a downward extension of the front upright frame rod of said front divider panel and the other of said panel mounting elements comprising a downward extension of the rearward upright frame rod of said back divider panel.

11. The adjustable depth shelf divider of claim 10, wherein said stabilizing element is fixed to said rearward upright frame rod of said back divider panel at a top of said downward extension thereof.

12. The adjustable depth shelf divider of claim 11, wherein one of said panel-mounting elements is formed by a downward extension of the rearward upright frame rod and said downward extension extends rearwardly at an angle to the vertical in a plane defined by said forward and rearward frame rods, and an upper portion of said rearward upright frame rod is angled forward from the vertical in said plane to accommodate upward tilting of said shelf divider during insertion of the rearwardly angled downward extension.

13. The adjustable depth shelf divider of claim 9, wherein said at least one retaining element comprises upper and lower retaining elements in upper and lower portions respectively of said divider panels.

14. The adjustable depth shelf divider of claim 13, wherein said upper retaining element is fixed to an upper back-panel-forming wire and extends downward therefrom, and said lower retaining element is fixed to a lower back-panel-forming wire and extends upward therefrom.

15. The adjustable depth shelf divider of claim 14, wherein each of said retaining elements is positioned to engage a single front-panel-forming wire, and the thus-engaged front-panel-forming wires are vertically deflectable in mid portions thereof for assembly of said front and back divider panels into overlapping, telescopically adjustable relation.

16. The adjustable depth shelf divider of claim 9, wherein a horizontally disposed upper frame rod extends between upper ends of the front and back frame rods of said front divider panel, and said upper frame rod is positioned at a height above an uppermost one of said back-panel-forming wires.

17. An adjustable depth wire shelf divider which comprises, front and back, vertically oriented overlapping divider panels, said front divider panel comprising front and back upright front panel supports and a plurality of vertically spaced and horizontally disposed front-panel-forming elements fixed at front and back ends thereof to laterally facing side surfaces of said and back front panel supports, a first panel-mounting element extending downward below a lowermost one of said front-panel-forming elements for reception in a shelf opening located adjacent a front edge of a shelf to be divided, said back divider panel comprising forward and rearward upright back panel supports and a plurality of vertically spaced and horizontally disposed back-panel-forming elements fixed at front and back ends thereof to laterally facing side surfaces of said back panel supports, panel-forming elements of the respective front and back divider panels being mounted on opposite side surfaces of the respective panel supports such that, when said front and back panels are assembled in overlapping relation panel-forming elements of one panel can make contact with panel-forming elements of the other panel, a vertical spacing between the horizontal panel-forming elements of the front and back panels being such that, when the panels are overlapped, the panel-forming elements of one panel are received in spaces between panel-forming elements of the other panel and at least one panel-forming element of one panel lies directly above and is slideably supported by at least one panel-forming element of the other panel, at least one retaining element mounted on a panel-forming element of one of the panels and extending vertically beyond one or more panel-forming elements of the other panel for retaining said panels in closely contacting relation with the panel-forming elements of said one panel lying substantially in a common plane with panel-forming elements of the other panel, while accommodating telescopic adjustment of said panels between predetermined limits, and a second panel-mounting element extending downward from a back of said back panel below a lowermost one of said back-panel-forming elements for reception in a shelf opening located adjacent to a back edge of the shelf to be divided.

18. The adjustable depth shelf divider of claim 17, wherein said at least one retaining element comprises upper and lower retaining elements, said upper retaining element is fixed to an upper back-panel-forming element and extends downward therefrom, and said lower retaining element is fixed to a lower back-panel-forming element and extends upward therefrom.

19. The adjustable depth shelf divider of claim 18, wherein each of said retaining elements is positioned to engage a single front-panel-forming element, and the thus-engaged front-panel-forming elements are vertically deflectable in portions thereof for initial assembly of said front and back divider panels into overlapping, telescopically adjustable relation.

20. The adjustable depth shelf divider of claim 17, wherein a stabilizing element in the form of a cross bar is fixed to a bottom of said back divider panel and extends transversely thereto on opposite sides of a plane defined by said forward and rearward back panel supports and is positioned to rest on a top surface of the shelf.

21. The adjustable depth shelf divider of claim 17, wherein at least one of said panel-mounting elements extends vertically downward and the other of said panel-mounting elements extends downward and rearward at an angle to the vertical.

* * * * *